US006148548A

United States Patent [19]

Tohji

[11] Patent Number: 6,148,548

[45] Date of Patent: Nov. 21, 2000

[54] CONSTRUCTION MACHINE

[75] Inventor: Yutaka Tohji, Hiroshima, Japan

[73] Assignee: Kabushiki Kaisha Kobe Seiko Sho, Kobe, Japan

[21] Appl. No.: 09/342,265

[22] Filed: Jun. 29, 1999

[30] Foreign Application Priority Data

Jun. 30, 1998 [JP] Japan ..... 10-201142

[51] Int. Cl.[7] ..... E02F 5/02

[52] U.S. Cl. ..... 37/348; 60/421; 60/430; 60/429

[58] Field of Search ..... 37/348, 382, 347, 37/381, 902; 172/2, 3, 4, 4.5, 8; 701/50; 60/421, 422, 420, 428, 429, 430, 443

[56] References Cited

U.S. PATENT DOCUMENTS

| | | | |
|---|---|---|---|
| 5,052,179 | 10/1991 | Fujii | 60/421 |
| 5,101,627 | 4/1992 | Fujii | 60/429 |
| 5,392,539 | 2/1995 | Hirata et al. | 37/348 |
| 5,446,979 | 9/1995 | Sugiyama et al. | 37/348 |
| 5,722,190 | 3/1998 | Arnold | 37/348 |
| 5,911,506 | 6/1999 | Nakamura et al. | 37/348 |
| 5,940,997 | 8/1999 | Toyooka et al. | 37/411 |
| 5,950,430 | 9/1999 | Tohji et al. | 60/426 |
| 6,018,895 | 2/2000 | Duppong et al. | 37/348 |

FOREIGN PATENT DOCUMENTS 4-070429 3/1992 Japan .

*Primary Examiner*—Victor Batson
*Attorney, Agent, or Firm*—Oblon, Spivak, McClelland, Maier & Neustadt, P.C.

[57] ABSTRACT

A construction machine comprising two hydraulic pumps; right and left traveling motors for causing the construction machine to travel; work machine actuators for actuating a work machine of the construction machine; a control valve which makes control so that a hydraulic oil discharged from the two hydraulic pumps is fed to at least either the right and left traveling motors or the work machine actuators and so that when both traveling operation and work machine operation are performed simultaneously, the hydraulic oil discharged from one of the two hydraulic pumps is fed to the traveling motors and the hydraulic oil from the other hydraulic pump is fed to the work machine actuators, the control valve providing communication between the two hydraulic pumps through a pump communication path; a drive signal detecting device which detects drive signals with respect to the two hydraulic pumps when the traveling operation and the work machine operation are performed simultaneously; and a controller which controls the controls valve so as to throttle or close the pump communication path in accordance with the drive signals detected by the drive signal detecting device. According to this construction machine, pressure interference is not likely to occur between the two hydraulic pumps, nor is it likely that oil may flow from a high pressure side to a low pressure side, causing the high pressure side to become inoperative and the low pressure side to become accelerated.

6 Claims, 4 Drawing Sheets

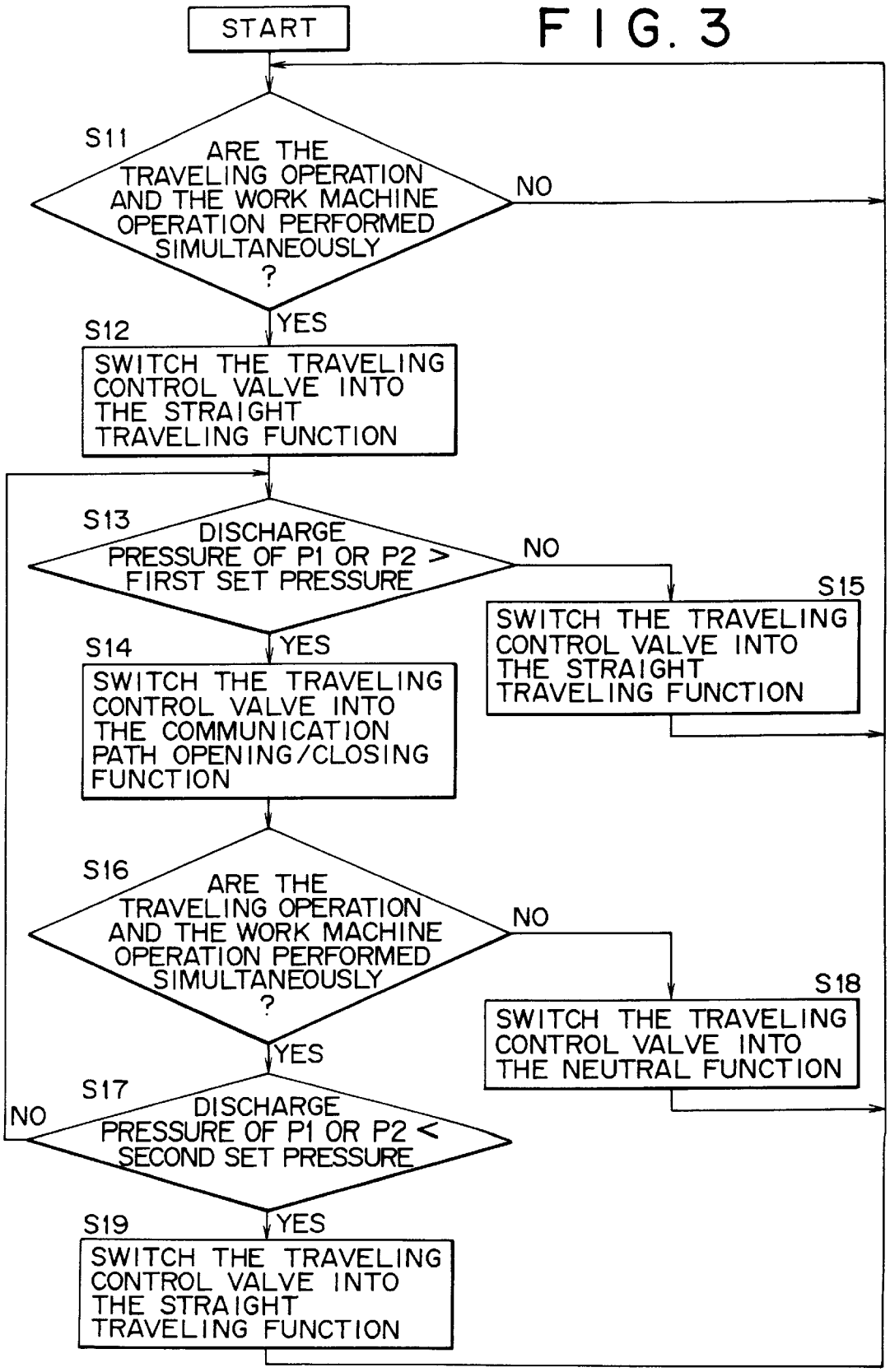
FIG. 3
START
S11
ARE THE TRAVELING OPERATION AND THE WORK MACHINE OPERATION PERFORMED SIMULTANEOUSLY ?
NO
YES
S12
SWITCH THE TRAVELING CONTROL VALVE INTO THE STRAIGHT TRAVELING FUNCTION
S13
DISCHARGE PRESSURE OF P1 OR P2 > FIRST SET PRESSURE
NO
S15
SWITCH THE TRAVELING CONTROL VALVE INTO THE STRAIGHT TRAVELING FUNCTION
YES
S14
SWITCH THE TRAVELING CONTROL VALVE INTO THE COMMUNICATION PATH OPENING/CLOSING FUNCTION
S16
ARE THE TRAVELING OPERATION AND THE WORK MACHINE OPERATION PERFORMED SIMULTANEOUSLY ?
NO
S18
SWITCH THE TRAVELING CONTROL VALVE INTO THE NEUTRAL FUNCTION
YES
S17
DISCHARGE PRESSURE OF P1 OR P2 < SECOND SET PRESSURE
NO
YES
S19
SWITCH THE TRAVELING CONTROL VALVE INTO THE STRAIGHT TRAVELING FUNCTION

CONSTRUCTION MACHINE

BACKGROUND OF THE INVENTION

1. Field of the Invention

The present invention relates to a construction machine such as a hydraulic excavator.

2. Description of the Related Art

An example of a conventional hydraulic excavator will be described below with reference to FIG. 4 which is a side view thereof.

In the same figure, the reference numeral 30 denotes a hydraulic excavator. The hydraulic excavator 30 has a lower carriage 31. The lower carriage 31 is provided with a pair of crawlers 31*a*, the crawlers 31*a* each comprising a track frame 31*b*, an idler wheel 31*c* and a traveling motor 31*d* which are mounted through shafts at front and rear ends, respectively, of the track frame 31*b*, and a shoe 31*e* entrained on both idler wheel 31*c* and traveling motor 31*d*. The paired crawlers 31*a* are connected together through a center frame (not shown).

On top of the lower carriage 31 is mounted a rotatable superstructure 32. The rotatable superstructure 32 is provided with a counter weight 32*a* mounted at the rear end thereof and a cab 37 formed at the front portion thereof. The cab 37 is provided with an operator seat (not shown) disposed at a rear position in the interior of the cab, a pair of operating levers (not shown) disposed at both side positions in front of the operator seat, and a pair of traveling levers (not shown) disposed in front of the operator seat.

In front of the cab 37 is provided an attachment 33 so that it can rise and fall with a boom foot pin (not shown) as fulcrum, the attachment 33 comprising a boom 34, an arm 35 and a bucket 36. The boom 34 is made capable of rise and fall by means of a boom cylinder 34*a* both ends of which are connected respectively to the front end of rotatable superstructure 32 and the boom 34. The arm 35 is connected pivotably to the front end of the boom 34. The arm 35 is made pivotable by means of an arm cylinder 35*a* which is disposed between the back of the boom 34 and a base end of the arm 35. The bucket 36 is mounted pivotably at a front end portion of the arm 35. The bucket 36 is made pivotable by means of a bucket cylinder 36*a* disposed between the bucket and the back of the arm 35.

An operator of the hydraulic excavator sits on the operator seat and operates the traveling levers to supply a hydraulic oil to each traveling motor 31*d* from a hydraulic pump which is mounted in the interior of the rotatable superstructure and which will be described later, thereby causing movement of the hydraulic excavator. Likewise, the operator operates the operating levers to supply the hydraulic oil from the hydraulic pump to a rotating motor which will be described later, thereby causing rotation of the rotatable superstructure. Further, the hydraulic oil is fed to the cylinders 34*a*, 35*a* and 36*a* to actuate the attachment 33, thereby performing operations such as excavation.

The above conventional hydraulic excavator is provided with two such hydraulic pumps as referred to above. By operation of a control valve, for example during work, a first pump is used for the boom cylinder 34*a* and the bucket cylinder 36*a* and a second pump is used for the arm cylinder 35*a* and the rotating motor (not shown). On the other hand, during traveling, the first and second pumps are used for a right traveling motor (31*d*) and a left traveling motor (31*d*), respectively. This state is assumed to indicate that the control valve is in the position of neutral function.

Further, in the case where the traveling motors 31*d* and any (hereinafter referred to as the "work machine actuator") of the boom cylinder 34*a*, bucket cylinder 36*a*, arm cylinder 35*a* and rotating motor (not shown) are driven at a time, the first and second pumps, for example, are used exclusively for the work machine actuator and the traveling pump, respectively. This state is assumed to indicate that the control valve is in the position of independent traveling function.

However, even when the work machine actuator is driven while both right and left traveling motors are in operation, the control valve switches from the position of neutral function to the position of independent traveling function, so that switching is made from the previous oil distribution to the right and left traveling motors by the first and second pumps respectively into the oil distribution to both right and left traveling motors by only the second pump. Consequently, the load on the second pump doubles and the flow rate is reduced by half, thus giving rise to a deceleration shock.

In general, therefore, the independent traveling function of the control valve is changed into a straight traveling function while providing a pump communication path for communication between the first and second pumps. By so doing, even where the traveling motors and the work machine actuator are driven at a time, the oil present in the first pump is distributed to the second pump, whereby a shock such as a deceleration shock is cushioned to a certain extent.

However, the following problem has been encountered in the aforesaid change from the independent traveling function of the control valve to the straight traveling function.

When the work machine actuator is to be operated while the hydraulic excavator is moving up a steep slope (say at a second pump pressure of 300 k) and when the work which is done by the work machine actuator is under no load or under a light load (say at a first pump pressure of 100 k), the oil present on the second pump side flows to the first pump side through the first-second pump communication path in the straight traveling function, with the result that the traveling of the excavator stops and the work machine accelerates.

Conversely, when the boom as a work machine is operated in its rising direction in a state in which the traveling motor pressure is not so high (say at a second pump pressure of 100 k), for example during a load lifting work on a level ground, the oil present on the first pump side flows to the second pump side by the straight traveling function because of a high boom rising load pressure (say 200 k), so that the traveling speed increases and the motion of the work machine becomes slow or stops.

More particularly, with the control valve assuming the position of straight traveling function, when the hydraulic pressure on either the traveling side or the work machine side becomes high, oil flows to the low pressure side through the first-second pump communication path in the straight traveling function, thus giving rise to the problem that the high-pressure side becomes inoperative or the low-pressure side accelerates.

SUMMARY OF THE INVENTION

It is an object of the present invention to provide a construction machine capable of preventing pressure interference even in the event the operating pressure of traveling motors or of a work machine actuator becomes high when both traveling operation and work machine operation are performed simultaneously.

The construction machine of the present invention comprises two hydraulic pumps; right and left traveling motors for causing the construction machine to travel; work machine actuators for actuating a work machine of the construction machine; a control valve which makes control so that a hydraulic oil discharged from the two hydraulic pumps is fed to at least either the light and left traveling motors or the work machine actuators and so that when both traveling operation and work machine operation are performed simultaneously, the hydraulic oil discharged from one of the two hydraulic pumps is fed to the traveling motors and the hydraulic oil from the other hydraulic pump is fed to the work machine actuators, the control valve providing communication between the two hydraulic pumps through a pump communication path; drive signal detecting means which detects drive signals with respect to the two hydraulic pumps when the traveling operation and the work machine operation are performed simultaneously; and a controller which controls the control valve so as to throttle or close the pump communication path in accordance with the drive signals detected by the drive signal detecting means.

In the present invention it is not likely that there may occur a pressure interference between the two hydraulic pumps, and therefore there is no fear that oil may flow from the high pressure side to the low pressure side, resulting in the high pressure side becoming inoperative or the low pressure side becoming accelerated.

The controller may be constructed so as to compare the drive signals detected by the drive signal detecting means and throttle or close the pump communication path when the difference in magnitude between the drive signals is larger than a predetermined value or throttle or close the same path when the magnitude of one of the drive signals is larger than a predetermined value.

The drive signal detecting means may be attached to each of the two hydraulic pumps. In this case, since drive signals from the two hydraulic pumps are detected directly and therefore can be compared with each other easily.

The drive signal detecting means may be attached to each of the traveling motors and the work machine actuators. In this case, it is possible to control the communication path between the two hydraulic pumps in accordance with drive signals from the traveling motors and the work machine actuators.

BRIEF DESCRIPTION OF THE DRAWINGS

FIG. 3 is a flowchart showing a method for controlling a control valve used in a construction machine according to the second embodiment of the present invention.

DESCRIPTION OF THE PREFERRED EMBODIMENTS

Embodiments of the present invention will be described hereinunder with reference to FIGS. 1 to 3.

Figure 1:
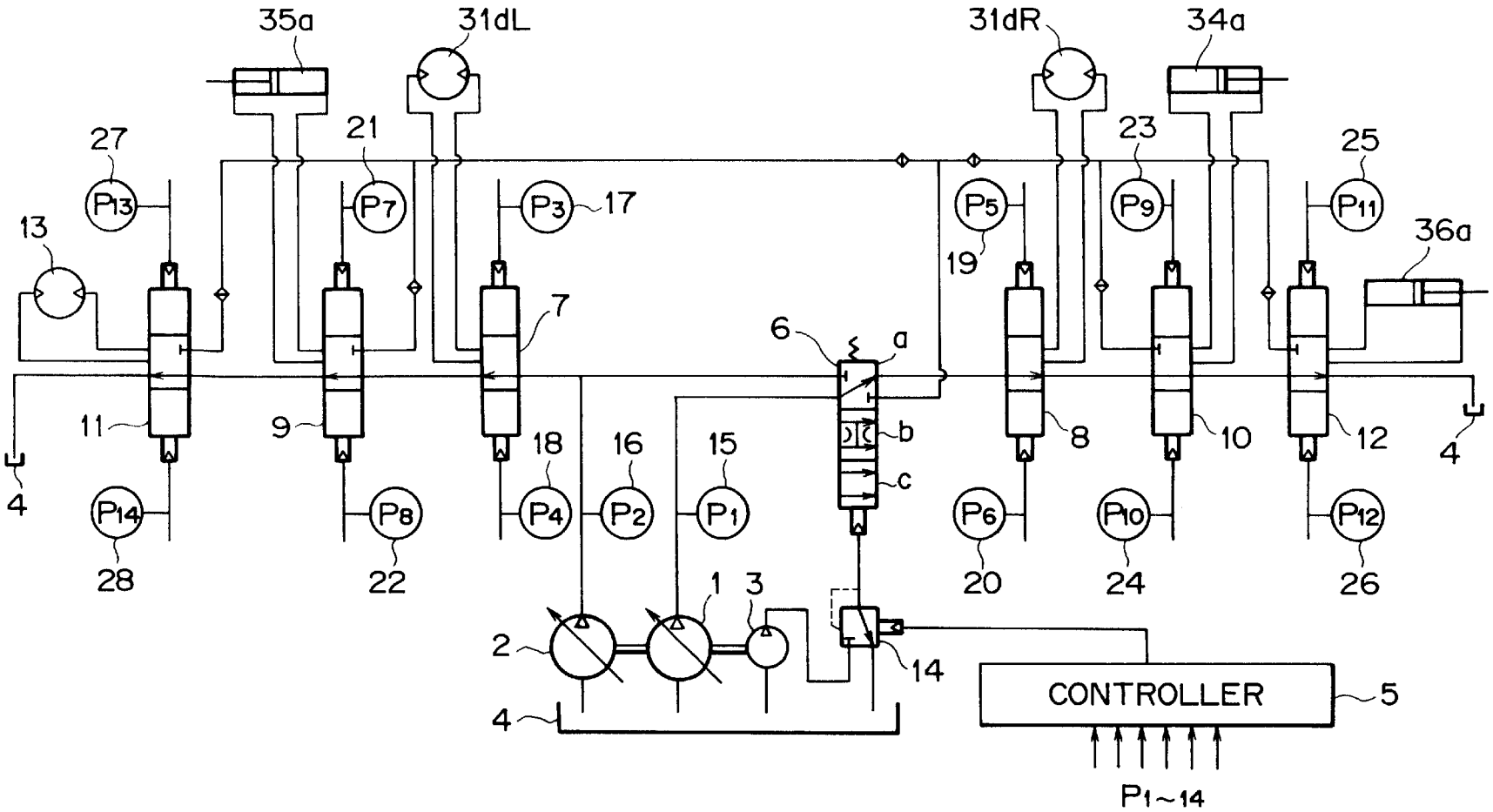
FIG. 1 is an electro-hydraulic circuit diagram of a construction machine according to the first embodiment of the present invention.
Figure 2:
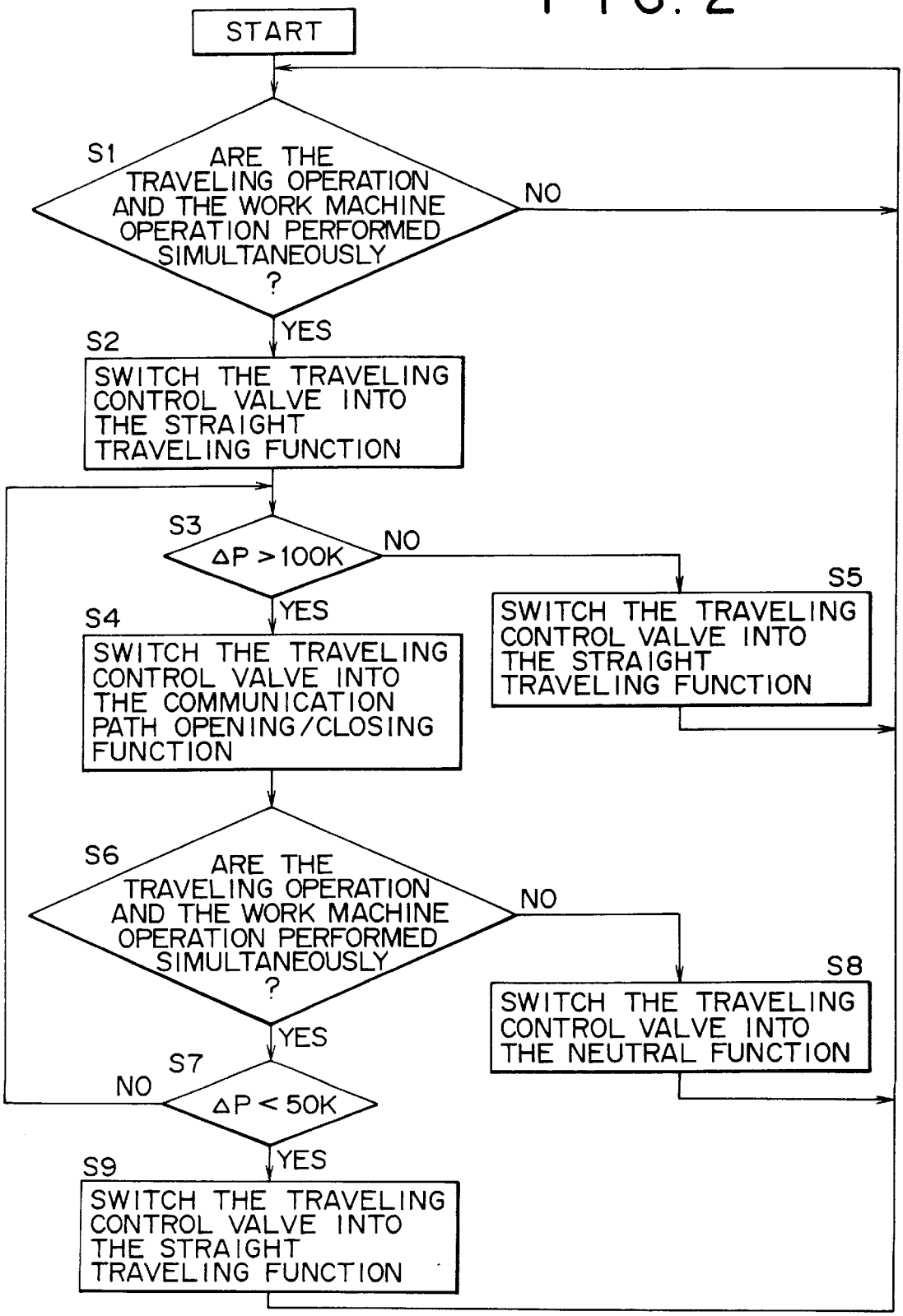
FIG. 2 is a flowchart showing a method for controlling a control valve used in the construction machine of the first embodiment.

FIRST EMBODIMENT (FIGS. 1 and 2)

Figure 4:
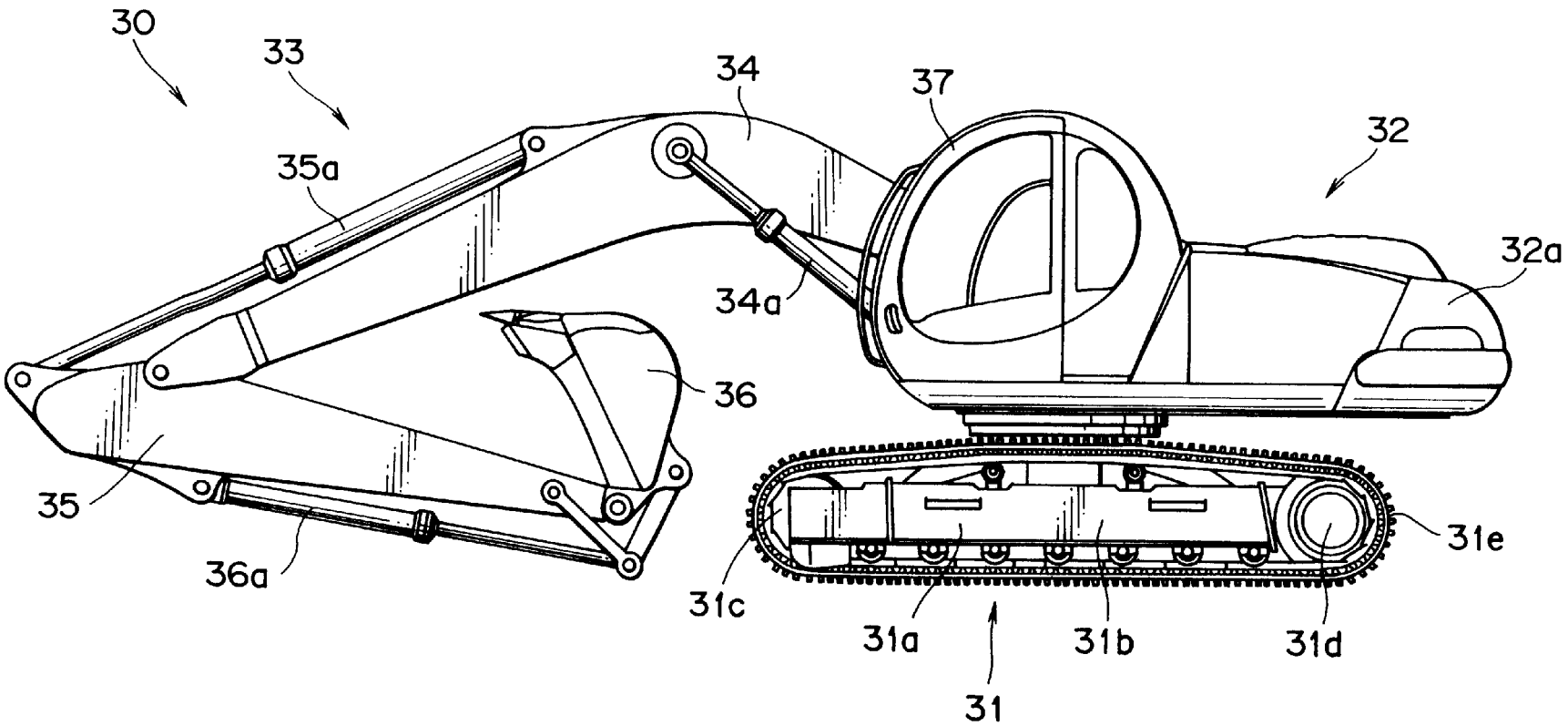
FIG. 4 PRIOR ART
FIG. 4 is a side view of a conventional hydraulic excavator.

FIG. 1 is an electro-hydraulic circuit diagram of a construction machine according to the first embodiment of the present invention, in which the same constructional portions as in the prior art are identified by the same reference numerals as in FIG. 4.

In FIG. 1, the numerals 31dL and 31dR denote left and right traveling motors mounted on a lower carriage 31. The left and right traveling motors 31dL, 31dR are connected with traveling pilot change-over valves 7 and 8, respectively, through conduit lines . The traveling motors 31dL and 31dR are controlled by operation of the traveling pilot change-over valves 7 and 8 which is done as necessary by operation of the foregoing paired traveling levers.

Numeral 13 denotes a rotating motor mounted on a rotatable Superstructure 32. The rotating motor 13 and a rotating pilot change-over valve 11 are connected with each other through a conduit line. The rotating motor 13 is controlled by operation of the rotating pilot change-over valve 11 which is done as necessary by operation of the foregoing operating levers.

Numerals 34*a*, 35*a* and 36*a* denote a boom cylinder, an arm cylinder and a bucket cylinder, respectively, which are mounted on an attachment 33. The cylinders 34*a*, 35*a* and 36*a* are connected respectively to a pilot changeover valve 10 for the boom, a pilot change-over valve 9 for the arm and a pilot change-over valve 12 for the bucket, through conduit lines. The cylinders 34*a*, 35*a* and 36*a* are controlled by operation of the pilot change-over valves 10, 9 and 12 which is done as necessary by operation of the foregoing paired operating levers.

In this embodiment the rotating motor 13, boom cylinder 34*a*, arm cylinder 35*a* and bucket cylinder 36*a* correspond to work machine actuators, but no limitation is made thereto. Actuators other than the left and right traveling motors 31dL, 31dR correspond thereto.

Numerals 1 and 2 denote first and second pumps (hydraulic pumps), respectively, for the discharge of hydraulic oil. Numeral 4 denotes an oil tank and numeral 6 denotes a control valve.

The hydraulic oil sucked up from the oil tank 4 by the first pump 1 passes through the control valve 6, further through the traveling pilot change-over valve 8, pilot change-over valve 10 for the boom and the pilot change-over valve 12 for the bucket, and is fed to the traveling motor 31dR, boom cylinder 34*a* and bucket cylinder 36*a* to drive them. Thereafter, it is relieved to the oil tank 4.

On the other hand, the hydraulic oil sucked up from the oil tank 4 by the second pump 2 flows through the control valve 6, further through the traveling pilot change-over valve 7, pilot change-over valve 9 for the arm and rotating pilot change-over valve 11, and is fed to the traveling motor 31dL, arm cylinder 35*a* and rotating motor 13 to drive them. It is then relieved to the oil tank 4.

The control valve 6 is provided with a neutral function, a, a straight traveling function, b, and a communication path opening/closing function, c. The neutral function, a, and the straight traveling function, b, are almost the same as the neutral function and the straight traveling function both referred to above in connection with the prior art. As to the communication path opening/closing function, it will be described later. A control operation, or a change-over operation, for the control valve is carried out by means of a controller 5 which will be described later. In more particular terms, the control valve 6 is changed over to each of the functions a~c by exertion of a pilot pressure on a pilot port of the control valve 6 which pilot pressure is discharged from a pilot pump 3. This change-over control is effected by controlling a relief valve 14 disposed between the pilot port of the control valve 6 and the pilot pump 3, which control is made by the controller 5 to be described later.

Numerals 15 and 16 denote pressure sensors as drive signal detecting means for detecting pump pressures discharged from the first and second pumps 1, 2.

Numerals 17 to 20 denote pressure sensors for detecting left and right traveling operations, the pressure sensors 17 to 20 being disposed between left and right traveling levers (not shown) and the left and right pilot change-over valves 7, 8. Numerals 21 to 28 denote pressure sensors for detecting work machine operations, the pressure sensors 21 to 28 being disposed between operating levers (not shown) and the pilot change-over valves 9 to 12 for the work machine.

Pressures detected by the pressure sensors 17 to 28 are inputted as operation signals to the controller 5. In the following manner the controller 5 discriminates the operation signals fed from the pressure sensors 15~28 and actuates the control valve 6 in accordance with the thus-discriminated operations signals.

If the operation signals fed to the controller 5 are either the left and right operation signals (pressure sensors 17 to 20) or the work machine operation signals (pressure sensors 21 to 28), the controller 5 holds the control valve 6 at the position of the neutral function, a.

On the other hand, if the operation signals fed to the controller 5 are both left and right operation signals (pressure sensors 17 to 20) and work machine operation signals (pressure sensors 21 to 28), the controller 5 changes over the position of the control valve 6 to the position of the straight traveling function, b.

The controller 5 is provided with a drive signal comparing means which compares the magnitudes of discharge pressures (drive signals) detected by the pressure sensors 15 and 16 serving as drive signal detecting means. If the difference between both discharge pressures is found to be large (say look or more) as a result of comparison made by the drive signal comparing means, the pump communication path between the first and second hydraulic pumps is closed. That is, the position of the control valve 6 is changed over from the straight traveling function, b, to the communication path opening/closing function, c, which serves as a communication path control means.

FIG. 2 is a flowchart showing how to control the control valve used in the construction machine of the first embodiment.

In the same figure, first in step S1, there is made judgment as to whether a traveling operation and a work machine operation are being performed simultaneously. If the answer is affirmative, the flow advances to step S2. On the other hand, if it is one operation that is being performed, the flow returns to step S1.

In step S2, on the basis of the result of step S1, the control valve 6 is changed over from its neutral function, a, to its straight traveling function, b, and the flow shifts to step S3.

In step S3, there is made a comparison between the discharge pressure from the first pump 1 and that from the second pump 2. If the resulting difference (ΔP) is at a level (say above 100 k) at which pressure interference is apt to occur, the flow shifts to step S4. Conversely, if the discharge pressure difference (ΔP) is at a level (say 100 k or less) at which pressure interference is difficult to occur, the flow shifts to step S5.

In step S4, since it was judged in step S3 that the discharge pressure difference (ΔP) between the first pump 1 and the second pump 2 was large and reached the level of easy occurrence of pressure interference, the control valve 6 is changed over from its straight traveling function, b, to its communication path opening/closing function, c, in order to prevent the occurrence of pressure interference, and then the flow shifts to step S6.

In step S5, since it was judged in step S3 that the discharge pressure difference (ΔP) between the first and second pumps was not so large and did not reach the level of easy occurrence of pressure interference, the control valve 6 is changed over to its straight traveling function, b, and the flow returns to step S1.

In steps S6 et seq., judgment is repeated as to in what manner the control valve 6 is to be changed over, taking work contents or ever-changing discharge pressures of the first and second pumps into account. More specifically, in step S6 there is made judgment as to whether a traveling operation and a work machine operation are being conducted at a time, and if the answer is affirmative, the magnitude of a discharge pressure difference (ΔP) is checked and the flow shifts to step S7 for judging to which function the control valve 6 is to be changed over. Conversely, if it is only one operation that is being conducted, the flow shifts to step S8 because there is no fear of pressure interference occurring between the first pump 1 and the second pump 2.

In step S7 it is judged whether the discharge pressure difference (ΔP) between the first and second pumps 1, 2 is at the level of easy occurrence of pressure interference. If the discharge pressure difference (ΔP) is found to be at a level (say below 50 k) at which the possibility of pressure interference is extremely low, the flow shifts to step S9 because the occurrence of pressure interference is not likely at all. Conversely, if the discharge pressure difference (ΔP) is at a level (say 50 k or more) at which there may occur a pressure interference, the flow returns to step S3 to judge whether the discharge pressure difference is at a level (say 100 k or more) at which pressure interference is still easier to occur.

In step S8, since it was judged in step S6 that only one of a traveling operation and a work machine operation was being performed, the position of the control valve 6 is changed over from its straight traveling function, b, to its neutral function, a, and the flow returns to step S1.

In step S9, since it was judged in step S7 that the discharge pressure difference (ΔP) between the first and second pumps 1, 2 was at a level (say below 50 k) of an extremely low possibility of pressure interference, the control valve 6 is changed over from its communication path opening/closing function, c, to its straight traveling function, b and the flow returns to step S1.

Although in this embodiment the discharge pressures of the first and second pumps 1, 2 are detected as drive signals, this constitutes no limitation. Drive pressures of the left and right traveling motors 31dL, 31dR and of the work machine actuators 13, 34*a*, 35*a*, 36*a* may be detected. In this case, the higher side of the drive pressures of both traveling motors 31dL, 31dR may, for example, substitute the discharge pressure of the second pump 2, and out of the work machine actuators 13, 34*a*, 35*a* and 36*a*, the one which is of the highest drive pressure may substitute the discharge pressure of the first pump. As to the work machine actuators, a certain specific drive pressure (say the boom heat pressure) may be used as a substitute for the discharge pressure of the first pump 1.

Although in this embodiment the communication path opening/closing function, c, is provided in the control valve 6 for the purpose of completely closing the communication path between the first and second pumps, this constitutes no limitation. For example, the first-second pump communication path may be throttled.

Further, although in this embodiment pressure sensors are used for the detection of drive signals, pressure switches or the like may be used for the same purpose.

SECOND EMBODIMENT (FIGS. 1 and 3)

Since the components used in a construction machine according to this second embodiment are of the same structures as those used in the construction machine of the above first embodiment, except the controller 5, reference will be made to FIG. 1 and explanations thereof omitted here.

Operations of the left and right traveling operation levers are detected by the pressure sensors 17~28 and are inputted as operation signals to the controller. Further, discharge pressures of the first and second pumps 1, 2 are detected by the pressure sensors 15 and 16, respectively, and are inputted as drive signals to the controller.

The controller performs the following discrimination for the operation signals inputted from the pressure sensors 15~28 and actuates the control valve 6 in accordance with the thus-discriminated operation signals.

If the operation signals inputted to the controller are either the left and right traveling operation signals (pressure sensors 17~20) or the work machine operation signals (pressure sensors 21~28), the controller holds the control valve 6 at the position of the neutral function, a.

On the other hand, if the operation signals inputted to the controller are both the left and right traveling operation signals (pressure sensors 17~20) and the work machine operation signals (pressure sensors 21~28), the controller changes over the position of the control valve 6 to the position of the straight traveling function, b.

The controller then checks the magnitudes of the drive signals from the first and second pumps 1, 2 which have been detected by the pressure sensors 15 and 16 as drive signal detecting means. If the drive signal from one of the first and second pumps is higher than a predetermined value, the controller makes control to close the first-second pump communication path. That is, the controller changes over the position of the control valve 6 from the straight traveling function, b, to the communication path opening/closing function, c, which serves as a communication path control means.

FIG. 3 is a flowchart showing how to control the control valve used in the construction machine of this second embodiment.

In the same figure, in step S11 there is made judgment as to whether a traveling operation and a work machine operation are being performed simultaneously. If the answer is affirmative, the flow shifts to step S12, while if the answer is negative, the flow returns to step S11.

In step S12, on the basis of the result obtained in step S11 the position of the control valve 6 is changed over from the neutral function, a, to the straight traveling function, b, and the flow shifts to step S13.

In step S13, the magnitudes of discharge pressures from the first pump 1 (p1) and the second pump 2 (P2) are checked. If the discharge pressure of either the first pump 1 or the second pump 2 is higher than a first preset pressure (a pressure at which pressure interference will apt to occur), the flow shifts to step S14 because there is a fear that pressure interference may occur between both pumps. Conversely, if the said discharge pressure is lower than the first preset pressure, the flow shifts to step S15 because of a low possibility of pressure interference between both pumps.

In step S14, since it was judged in step S13 that pressure interference might occur between the first and second pumps 1, 2, the controller changes over the position of the control valve 6 from the straight traveling function, b, to the communication path opening/closing function, c, to prevent the occurrence of pressure interference. Then, the flow shifts to step S16.

In step S15, since it was judged in step S13 that the possibility of pressure interference between the first and second pumps 1, 2 was low, the controller changes over the position of the control valve 6 to the straight traveling function, b, and the flow returns to step S11.

In steps S16 et seq., judgment is repeated as to in what manner the control valve 6 is to be changed over, taking work contents and ever-changing discharge pressures from the first and second pumps 1, 2 into account. More specifically, in step S16 there is made judgment as to whether the traveling operation and the work machine operation are still being conducted simultaneously, and if the answer is affirmative, the magnitudes of discharge pressures from the first and second pumps 1, 2 are checked and the flow shifts to step S17 for judging to which function the control valve 6 should be changed over. On the other hand, if the answer in step S16 is negative, that is, if it is only one operation that is being performed, the flow shifts to step S18 because of a low possibility of pressure interference between both pumps.

In step S17, it is judged whether there still is a fear of occurrence of pressure interference with respect to the magnitudes of discharge pressure from the first pump 1 (P1) and the second pump 2 (P2). If the discharge pressure of either the first pump 1 or the second pump 2 is lower than a second preset pressure, which is lower than the first preset pressure and which corresponds to a level of an extremely low possibility of pressure interference, the flow shifts to step S19 because it is possible to judge that the possibility of pressure interference is extremely low. On the other hand, if the said discharge pressure is higher than the second preset pressure, the flow returns to step S13 because pressure interference is likely to occur.

In step S18, since it was judged in step S16 that only one of the traveling operation and the work machine operation was being performed, the position of the control valve 6 is changed over from the straight traveling function, b, to the neutral function, a, and the flow returns to step S11.

In step S19, since it was judged in step S17 that the discharge pressure of either the first or the second pump was lower than the second preset pressure and that the possibility of pressure interference was extremely low, the position of the control valve 6 is changed over from the communication path opening/closing function, c, to the straight traveling function, b, and the flow returns to step S11.

Although in this embodiment the control valve 6 is provided with the communication path opening/closing function, c, for completely closing the communication path between the first and second pumps, this constitutes no limitation. For example, the communication path may be throttled.

Further, the pressure sensors used for detecting drive signals may be substituted by pressure switches or the like.

I claim:

1. A construction machine comprising:

two hydraulic pumps;

right and left traveling motors for causing the construction machine to travel;

work machine actuators for actuating a work machine of the construction machine;

a control valve which makes control so that a hydraulic oil discharged from said two hydraulic pumps is fed to at least either said right and left traveling motors or said work machine actuators and so that when a traveling operation and a work machine operation are performed simultaneously, the hydraulic oil discharged from one of said two hydraulic pumps is fed to said traveling motors and the hydraulic oil from the other hydraulic pump is fed to said work machine actuators, said control valve providing communication between said two hydraulic pumps through a pump communication path;

drive signal detecting means which detects drive signals with respect to said two hydraulic pumps when the traveling operation and the work machine operation are performed simultaneously; and a controller which controls said control valve so as to throttle or close said pump communication path in accordance with the drive signals detected by said drive signal detecting means.

2. A construction machine according to claim 1, wherein said controller compares the drive signals detected by said drive signal detecting means and throttles or closes said pump communication path when the difference in magnitude between the drive signals is larger than a predetermined value.

3. A construction machine according to claim 1, wherein said controller compares the drive signals detected by said drive signal detecting means and throttles or closes said pump communication path when the magnitude of one of the drive signals is larger than a predetermined value.

4. A construction machine according to claim 1, wherein said drive signal detecting means is attached to each of said two hydraulic pumps.

5. A construction machine according to claim 1, wherein said drive signal detecting means is attached to each of said traveling motors and said work machine actuators.

6. A construction machine with two hydraulic pumps mounted thereon and wherein at the time of a traveling operation said two hydraulic pumps drive right and left traveling motors respectively, while when a traveling operation and a work machine operation are performed simultaneously, the traveling motors are driven by one of said hydraulic pumps and work machine actuators are driven by the other hydraulic pump, said two hydraulic pumps being in communication with each other, characterized by including:

drive signal detecting means for detecting drive signals with respect to said two hydraulic pumps when both said traveling operation and work machine operation are performed simultaneously; and communication path control means which throttles or closes a communication path between said two hydraulic pumps in accordance with the drive signals detected by said drive signal detecting means.

* * * * *